US006497063B1

(12) United States Patent
Stephens

(10) Patent No.: US 6,497,063 B1
(45) Date of Patent: Dec. 24, 2002

(54) LABELING SYSTEM AND METHOD

(76) Inventor: Melinda J. Stephens, 2802 Wildcreek Ct., Keller, TX (US) 76248

( * ) Notice: Subject to any disclaimer, the term of this patent is extended or adjusted under 35 U.S.C. 154(b) by 33 days.

(21) Appl. No.: 09/595,436

(22) Filed: Jun. 15, 2000

(51) Int. Cl.[7] ..... G09F 3/10
(52) U.S. Cl. ..... 40/638; 40/6; 40/665
(58) Field of Search ..... 40/6, 638, 661.12, 40/630, 633, 665

(56) References Cited

U.S. PATENT DOCUMENTS

| | | | | |
|---|---|---|---|---|
| 3,226,862 A | | 1/1966 | Gabruk | 40/2 |
| 3,228,129 A | * | 1/1966 | Gwinn et al. | 40/6 |
| 3,235,986 A | | 2/1966 | Blish | 40/2 |
| 3,561,808 A | | 2/1971 | Beier et al. | 292/307 |
| D245,290 S | | 8/1977 | Kingsford | D96/12 R |
| 4,180,284 A | | 12/1979 | Ashley | 283/20 |
| 4,277,902 A | * | 7/1981 | Miniaci et al. | 40/6 |
| 4,415,612 A | | 11/1983 | Hall et al. | 428/29 |
| 4,513,522 A | | 4/1985 | Selenke | 40/2 R |
| 4,557,971 A | | 12/1985 | Williams | 428/343 |
| 4,631,845 A | | 12/1986 | Samuel et al. | 40/2 R |
| 4,679,823 A | | 7/1987 | Nagy | 281/15 A |
| 4,708,368 A | | 11/1987 | Instance | 283/81 |
| 4,716,052 A | | 12/1987 | Waugh et al. | 427/147 |
| 4,771,891 A | | 9/1988 | Sorensen et al. | 206/459 |
| 4,865,352 A | | 9/1989 | Gollon | 283/79 |
| 4,889,234 A | | 12/1989 | Sorensen et al. | 206/459 |
| D308,080 S | | 5/1990 | Sachs | D20/22 |
| 4,951,969 A | | 8/1990 | Epstein et al. | 283/67 |
| 5,001,853 A | | 3/1991 | Odien | 40/312 |
| 5,096,226 A | | 3/1992 | Steffen | 281/5 |
| 5,282,649 A | | 2/1994 | Williams et al. | 283/56 |
| D350,371 S | | 9/1994 | Rayle | D20/22 |
| 5,348,780 A | | 9/1994 | Boggs et al. | 428/42 |
| D352,526 S | | 11/1994 | Liebman | D20/22 |
| 5,366,249 A | * | 11/1994 | Diemert | 40/299 |
| 5,379,538 A | | 1/1995 | Osborne | 40/299 |
| 5,608,949 A | | 3/1997 | Cooley et al. | 24/30.5 R |
| 5,704,649 A | | 1/1998 | Small | 283/81 |
| 5,836,095 A | | 11/1998 | Crowell | 40/299 |
| 5,979,744 A | | 11/1999 | Brigleb | 229/87.01 |

FOREIGN PATENT DOCUMENTS

| | | | |
|---|---|---|---|
| JP | 07-56513 A | * | 3/1995 |
| JP | 08-95492 A | * | 4/1996 |

* cited by examiner

*Primary Examiner*—Cassandra H. Davis
(74) *Attorney, Agent, or Firm*—Robin A. Brooks; Munsch Hardt Kopf & Harr, P.C.

(57) ABSTRACT

A gift tag is disclosed. The gift tag includes a flexible material having a first portion, a second portion, and an elongated portion formed between the first and second portions. The gift tag also includes a second formed in the tag operable to release the first portion from the elongated portion. The first portion is operable to be released from the elongated portion and secured to a gift package, and the first portion, second portion, and elongated portion and secured to a gift package, and the first portion, second portion, and elongated portion and secure to a gift package, and the first portion, second portion, and elongated portion are operable to enclose at least a portion of the gift package when the first portion is secured to the second portion.

19 Claims, 1 Drawing Sheet

LABELING SYSTEM AND METHOD

TECHNICAL FIELD OF THE INVENTION

This invention relates generally to the field of tags and labels, and more particularly to a labeling system and method.

BACKGROUND OF THE INVENTION

A variety of tags and labels have been developed to secure to items such as gifts for many occasions. For example, holiday and/or other special-occasion labels and/or tags may be used to identify the recipient and/or donor of a gift. These tags may be secured to the gift using a variety of methods. For example, a tag may be attached to the gift using an adhesive such as tape, or other suitable attachment method, such as string or ribbon. Other types of labels may be provided with an adhesive that may be used to secure the label to the gift.

On the other hand, some tags have been developed to provide functionality that may be desired in addition to package identification. For example, some tags may employ folding means to selectively display information on one or more folded surfaces of the tag that would otherwise be displayed using a single surface. Other tags may be folded to transform the tag from an easily-dispensed form to another form that may be used for a specific purpose, such as identifying luggage for travel or jewelry for sale.

SUMMARY OF THE INVENTION

From the foregoing, it may be appreciated that a need has arisen for a labeling system and method. In accordance with the present invention, a system and method are provided that substantially reduce or eliminate disadvantages and problems of conventional systems.

One aspect of the invention is a gift tag. The gift tag includes a flexible material having a first portion, a second portion, and an elongated portion formed between the first and second portions. The gift tag also includes a section formed in the tag operable to release the first portion from the elongated portion. The first portion is operable to be released from the elongated portion and secured to a gift package, and the first portion, second portion, and elongated portion are operable to enclose at least a portion of the gift package when the first portion is secured to the second portion.

The invention provides several important advantages. Various embodiments of the invention may have none, some, or all of these advantages. The invention allows flexibility in using a single label to identify a variety of types and shapes of packages. For example, one technical advantage of the invention may allow a user to select how to identify a package such as a gift bag. The user may identify the gift bag by alternatively securing the label to the gift bag, or may enclose at least a portion of the gift bag, such as a handle, with the label. Another technical advantage of the invention allows a user to use two different methods of labeling to identify two different kinds of packages such as a book and the gift bag.

Another technical advantage of the invention is that it may be used to quickly and effortlessly enclose a portion of a package. Such an advantage may allow the user to identify the package without precise alignment of the label. Other technical advantages may be readily ascertainable by those skilled in the art from the following figures, description, and claims.

BRIEF DESCRIPTION OF THE DRAWINGS

For a more complete understanding of the present invention and the advantages thereof, reference is now made to the following descriptions taken in conjunction with the accompanying drawings, wherein like reference numerals represent like parts, and in which.

DETAILED DESCRIPTION OF THE DRAWINGS

Figure 1:
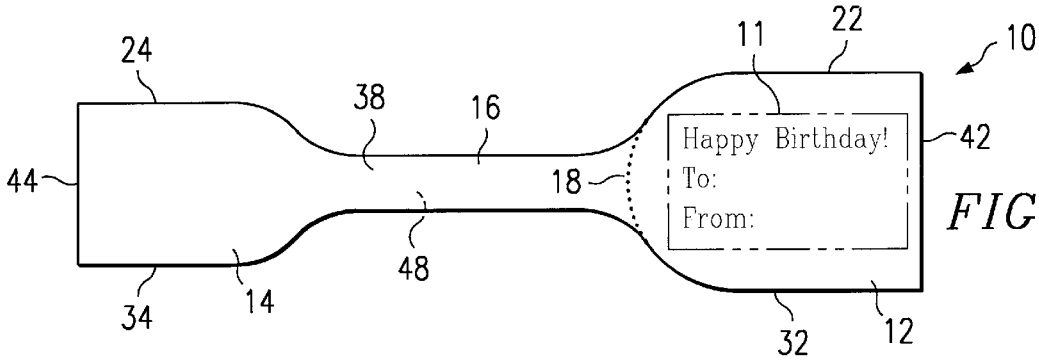
FIG. 1 is a plan view of a first side of the gift label in accordance with the present invention.

FIG. 1 is a plan view of a first side of a gift tag or label in accordance with the present invention. The terms label and tag may be used interchangeably for purposes of this application. Label 10 may be constructed from flexible material having a first side 38 and a second side 48. Label 10 includes a first portion 12, a second portion 14, and an elongated portion 16 between first portion 12 and second portion 14. First portion 12 may be released or decoupled from elongated portion 16 and second portion 14 by section 18. The position of section 18 may vary as desired, as will be described below.

In some applications, side 38 may include a pre-printed message 11 such as "From:" and "To:" identification portions typically associated with gift labels. Alternatively side 38 may be blank so that a customized message such as "Thinking of You" or "Happy Birthday!" may be affixed, written, typed, or otherwise placed on side 38 by a variety of methods. Alternatively or in addition, side 48 may include an adhesive portion 45, which is discussed in further detail in conjunction with FIG. 2.

In this embodiment, first portion 12 includes rounded edges 22, 32, and 42. That is, when first portion 12 is uncoupled from second portion 14, edges 22 and 32 form a U-shape. Similarly, second portion 14 includes rounded edges 24, 34, and 44. In this embodiment, second portion 14 is also smaller than first portion 12—that is, the area of second portion 14 is smaller than the area of first portion 12. Such an advantage may be useful when a user of label 10 desires to secure first portion 12 to second portion 14 without precisely aligning corresponding edges 22 and 24, 32 and 34, and/or 42 and 44.

The present invention contemplates a variety of shapes for first portion 12 and/or second portion 14 including, but not limited to, generally circular, square, triangular, rhomboidal, or any other desired shape. It may also be desirable for first portion 12 and elongated portion 16 to form a combined shape, such as an elephant. For example, elongated portion 16 may comprise the elephant's trunk, and first portion 12 may comprise the head and body of the elephant. In such an embodiment, the elephant-shaped label 10 may be recognizable when used to both enclose a portion of a package and to secure to the package. In addition, second portion 14 may be similarly shaped and larger than or generally equal in size to first portion 12. In other embodiments, second portion 14 may be sized and/or shaped dissimilarly to first portion 12.

In addition, label 10 may be sized as desired. For example, label 10 may include a longer elongated portion 16 to enclose portions of larger packages such as the gift sack pictured and discussed in conjunction with FIG. 3B. Conversely, it may be desirable to include a smaller elongated portion 16 to enclose portions of smaller packages such as the handle of the gift sack pictured and discussed in conjunction with FIG. 3A. First portion 12 and/or second portion 14 may each be sized independently from elongated portion 16.

Section 18 may be any suitable area within label 10 such as perforations or scoring that may be used to easily and completely decouple or release first portion 12 from elongated portion 16 and second portion 14. In this embodiment, section 18 includes perforations that create a generally semi-circular section between edges 22 and 32. Placement of section 18 may vary along elongated portion 16 as desired. For example, where first portion 12 is in the shape of an elephant, it may be aesthetically pleasing for section 18 to be placed further from first portion 12 (that is, nearer to second portion 14) so that elongated portion 16 appears to be the trunk of the elephant.

Label 10 may be constructed using a variety of flexible materials. For example, in one embodiment label 10 may be constructed from a variety of paper products suitable for package identification, whether coated, laminated or otherwise treated. The invention also contemplates the use of other textiles, fabrics, and other materials such as, but not limited to, leather, flexible polymer plastics, and other suitably flexible materials. In addition, label 10 may include a variety of colors and decorative features including, but not limited to, embossing, printing, painting, and/or adornments including, but not limited to, lace, fringe, and cording.

In operation, a single label 10 may be used to identify a package using at least two methods. For example, label 10 may enclose a handle of a gift sack as illustrated and discussed in further detail in conjunction with FIG. 3A. Alternatively, first portion 12 may be decoupled or released from elongated portion 16 and secured to the sack. Examples for these methods are illustrated and discussed further in conjunction with FIGS. 3A–3C. Alternatively or in addition, label 10 may be used to identify a variety of types and shapes of packages such as a boxed item and a gift sack where, for example, it may be advantageous to use different methods of labeling for each package type or shape. In this way, the invention may advantageously allow a user a choice in how he would like to identify a package such as a gift bag with a single label 10. The invention provides the user the advantage of using the same label to identify two different kinds of packages such as a book and the gift bag, using two different methods of labeling.

Figure 2:
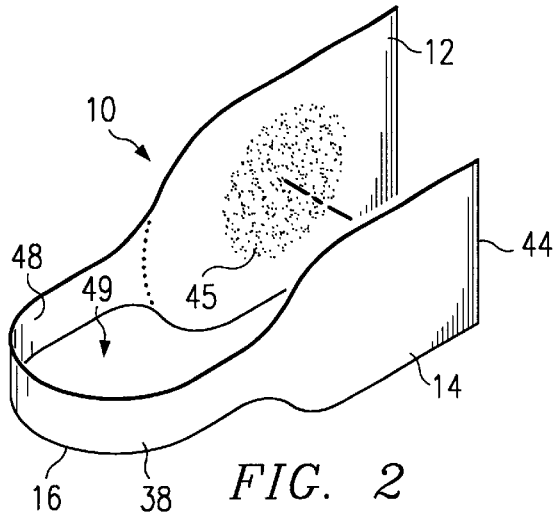
FIG. 2 is a perspective view of the gift tag of FIG. 1 illustrating a second side of a first portion and the first side of a second portion.

FIG. 2 is a perspective view of the gift label of FIG. 1 illustrating side 48 of first portion 12 and side 38 of second portion 14. Side 48 of first portion 12 may be secured to side 48 of second portion 14 by flexing elongated portion 16 as illustrated. Securing first portion 12 to second portion 14 forms an enclosure 49 in which at least a portion of a package may be enclosed. In this way, the invention may provide the advantage of allowing a user of label 10 to secure first portion 12 to second portion 14 without precisely aligning corresponding edges 22 and 24, 32 and 34, and/or 42 and 44 as shown in FIG. 1.

In this embodiment, a pressure-sensitive adhesive 45 may be applied to a portion or all of side 48 of first portion 12 to secure first portion 12 to second portion 14, releasably or otherwise. Alternatively or in addition, adhesive 45 may also be applied to all or a portion of side 48 of second portion 14.

The invention contemplates a variety of methods that may be used to secure first portion 12 to second portion 14 including, but not limited to, tape, glue, staples, cords, string, ribbon, and other suitable methods. In addition, a variety of adhesives 45 may be used that correspond to the material included in label 10. For example, continuous or full-gum coating, pattern-gum coating, and/or a variety of other coatings may be used, depending upon the application. In some applications, a plurality of gummed labels 10 may each be releasably coupled to one another to provide convenient access, storage, and use of each label 10.

Figure 3A:
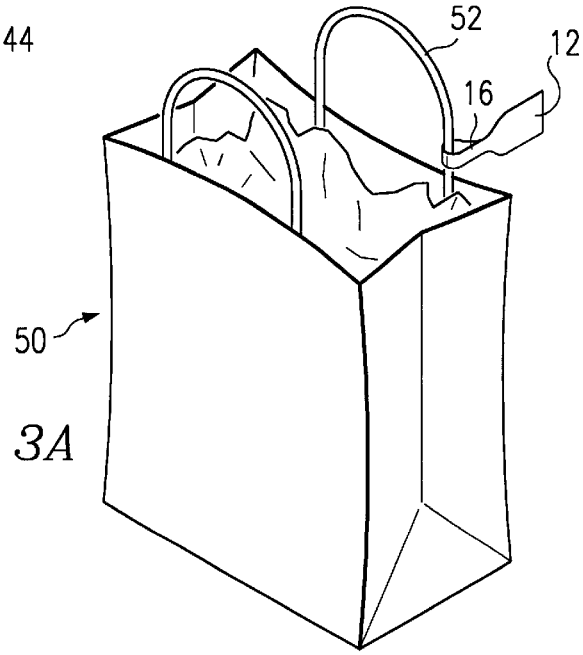
FIG. 3A is a graphic illustration of one method for identifying a package by enclosing at least a portion of the package with a gift tag.

FIG. 3A is a graphic illustration of a method for identifying a package by enclosing at least a portion of the package with a gift tag. Package 50 is graphically illustrated in FIG. 3A as an example of a gift sack or tote having two handles 52. Label 10 may enclose at least a portion of package 50, in this case one of handles 52. First portion 12 may be secured, releasably or otherwise, to second portion 14 as illustrated and discussed in conjunction with FIG. 2 to enclose one or more handles 52 to identify package 50. As illustrated in FIG. 3A, label 10 may generally freely rotate and/or translate about one or more handles 52. The invention also contemplates a variety of packages that may be similarly identified using label 10 including, but not limited to, cups, pitchers, briefcases, and other packages having a protrusion such as a handle.

Figure 3B:
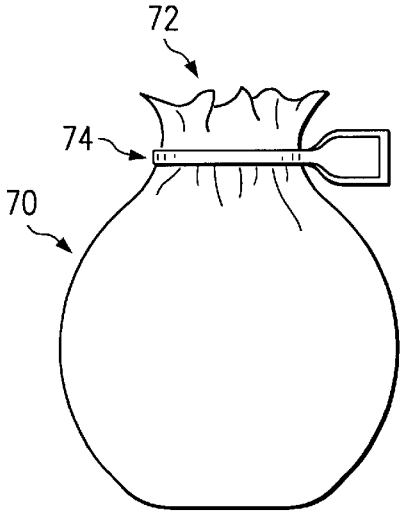
FIG. 3B is a graphic illustration of another method for identifying a package by enclosing at least a portion of the package with a gift tag.

FIG. 3B is a graphic illustration of another method for identifying a package by enclosing at least a portion of the package with a gift tag. In this embodiment, label 10 may also enclose at least a portion of package 70, which is graphically illustrated in FIG. 3B as an example of a sack or gift bag with a top enclosure 72. Portions of package 70 may be gathered to generally close or minimize top enclosure 72 using a variety of methods, including twisting, knotting, drawstrings, string, twist or other ties, or other suitable closure methods. As discussed above in conjunction with FIG. 3A, label 10 encloses neck 74 of package 70 when first portion 12 is secured, releasably or otherwise, to second portion 14. Depending on the application, label 10 may generally freely rotate and/or translate around neck 74. The invention also contemplates a variety of packages that may be similarly identified using label 10 where label 10 may enclose at least a portion of the package.

Figure 3C:
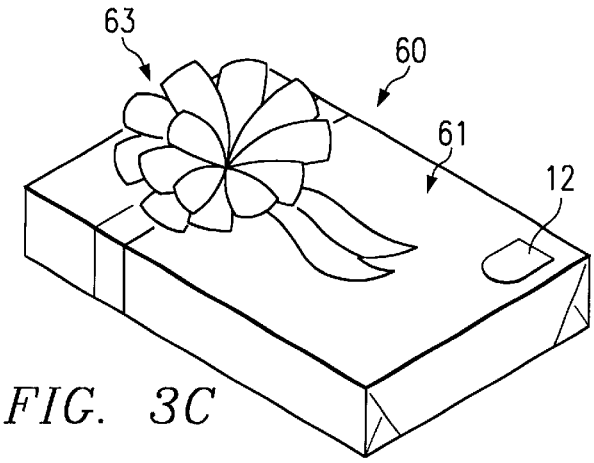
FIG. 3C is a graphic illustration of one method for identifying a package by securing a portion of a gift tag to the package.

FIG. 3C is a graphic illustration of one method for identifying a package by securing a portion of a gift tag to the package. Package 60 is graphically illustrated in FIG. 3C as an example of a wrapped gift box. Package 60 includes a decorative bow 63 in one corner and has at least one generally flat surface 61.

Package 60 may be identified using first portion 12 of label 10. First portion 12 may be released or decoupled from elongated portion 16 at section 18 and secured to package 60. First portion 12 may be secured to package 60 using a variety of methods such as, for example, adhesive 45. The invention also contemplates using label 10 to identify a variety of packages, having a generally flat surface or otherwise, where first portion 12 of label 10 may be secured to the package.

Thus, it is apparent that there has been provided in accordance with the present invention, a labeling system and method that satisfies the advantages set forth above. For example, the present invention allows flexibility in using a single label to identify a variety of types and shapes of packages. While the invention has been particularly shown by the foregoing detailed description, various changes, substitutions, and alterations may be readily ascertainable by those skilled in the art and may be made herein without departing from the spirit and scope of the present invention as defined by the following claims.

What is claimed is:

1. A gift tag, comprising:

a flexible material having a first portion, a second portion, and an elongated portion formed between the first and second portions;

a section formed in the tag operable to release the first portion from the elongated portion;

wherein the first portion has a securer and is operable to be released from the elongated portion and secured using the securer to a gift package to identify a recipient of the gift package; and the first portion, second portion, and elongated portion are operable to enclose at least a portion of the gift package when the first portion has not been released from the elongated portion and is secured using the securer to the second portion.

2. The gift tag of claim 1, wherein the section includes one of the group consisting of perforations and scoring.

3. The gift tag of claim 1, wherein the second portion is smaller in area than the first portion.

4. The gift tag of claim 1, wherein the flexible material includes a first side and a second side, and wherein the second side of the first portion is operable to couple to the second side of the second portion to enclose the at least a portion of the gift package.

5. The gift tag of claim 1, wherein the material is one of the group consisting of a paper textile, a plastic polymer, leather, and fabric.

6. The gift tag of claim 1, wherein the tag is operable to be secured to one of the gift package and the second portion by one of the group consisting of pressure-sensitive adhesive and gum adhesive.

7. The gift tag of claim 1, wherein the first portion is releasably secured to one of the gift package or the second portion.

8. A method for labeling a package, comprising: providing a gift tag comprising a flexible material having a first portion, a second portion, and an elongated portion formed between the first and second portions;

a section formed in the tag operable to release the first portion from the elongated portion;

wherein the first portion has a securer and is operable to be released from the elongated portion and secured using the securer to a first package to identify a recipient of the first package; and the first portion, second portion, and elongated portion are operable to enclose at least a portion of a second package when the first portion has not been released from the elongated portion and is secured using the securer to the second portion to identify a recipient of the second package.

9. The method of claim 8, wherein the second portion is smaller in area than the first portion.

10. The method of claim 8, further composing coupling a first side of the first portion to a first side of the second portion to enclose the at least a portion of the package.

11. The method of claim 8, wherein the material is one of the group consisting of a paper textile, a plastic polymer, leather and fabric.

12. The method of claim 8, further comprising securing the first portion to one of the package and the second portion by one of the group consisting of string, ribbon, pressure-sensitive adhesive, and gum adhesive.

13. The method of claim 8, wherein The first portion is releasably secured to one of the first package or the second portion.

14. A label, comprising:

a first portion of flexible material;

a second portion of the flexible material;

an elongated portion of the flexible material formed between the first portion and the second portion, the elongated portion releasably coupled to the first portion;

wherein the first portion has a securer and is operable to be uncoupled from the elongated portion and secured using the securer to a gift package to identify a recipient of the gift package; and the first portion, second portion, and elongated portion are operable to enclose at least a portion of the gift package when the first portion has not been released from the elongated portion and is secured using the securer to the second portion to identify the recipient of the gift package.

15. The label of claim 14, wherein the second portion is smaller in area than the first portion.

16. The label of claim 14, wherein the flexible material includes a first side and a second side, and wherein the second side of the first portion is operable to secure to the second side of the second portion to enclose the at least a portion of the gift packages.

17. The label of claim 14, wherein the material is one of the group consisting of a paper textile, a plastic polymer, leather, and fabric.

18. The label of claim 14, wherein the first portion is operable to be secured to one of the gift package or the second portion by one of the group consisting of pressure-sensitive adhesive and gum adhesive.

19. The label of claim 14, wherein the first portion is operable to be releasably coupled to the elongated portion by one of the group consisting of perforations and scoring.

* * * * *